United States Patent [19]

Leibson et al.

[11] Patent Number: 4,620,672

[45] Date of Patent: Nov. 4, 1986

[54] APPARATUS AND METHOD FOR CONVERTING PIPELINE FINE COAL SLURRY TO COAL WATER MIXTURE SUITABLE FOR DIRECT COMBUSTION IN BOILERS

[75] Inventors: Irving Leibson, Houston, Tex.; Horst Huettenhain, Benecia, Calif.

[73] Assignee: Bechtel International Corporation, San Francisco, Calif.

[21] Appl. No.: 697,985

[22] Filed: Feb. 4, 1985

[51] Int. Cl.[4] ..... B02C 19/12

[52] U.S. Cl. ..... 241/21; 44/51; 241/81; 241/170

[58] Field of Search ..... 110/221, 222; 44/51; 241/21, 24, 30, 38, 46 R, 81, 171, 170

[56] References Cited

U.S. PATENT DOCUMENTS 4,265,407 5/1981 Kessler et al. ..... 241/21
4,500,041 2/1985 Nakaoji et al. ..... 241/21 X

FOREIGN PATENT DOCUMENTS 1148917 6/1983 Canada ..... 241/21
2222865 11/1973 Fed. Rep. of Germany ... 241/169.1

*Primary Examiner*—Mark Rosenbaum
*Attorney, Agent, or Firm*—Townsend and Townsend

[57] ABSTRACT

A system for converting a coal slurry flowable through a pipeline to a coal water mixture capable of being rendered suitable for direct combustion in a boiler. The system includes a pipeline extending from a region adjacent to a mine or source of coal to a region adjacent to a boiler or furnace at which combustion is to take place. In the furnace region, the slurry from the pipeline is directed into a holding space, such as a pond, from which it is directed to a grinding apparatus. On the way to the grinding apparatus from the pond, a side stream of the slurry is directed through a dewatering apparatus where the concentration of the side stream is increased from 50–55 weight percent of solids to about 70–80 weight percent of solids. The outlet of the dewatering apparatus is directed back to the main flow of slurry from the pond, and the main flow enters the grinding apparatus where the slurry is ground to a particle size suitable for combustion, such as 70–80% weight percent of solids at −200 mesh. The ground slurry can then be directed into a small agitated tank and from this tank it can be directed into the boiler or furnace for combustion.

19 Claims, 3 Drawing Figures

APPARATUS AND METHOD FOR CONVERTING PIPELINE FINE COAL SLURRY TO COAL WATER MIXTURE SUITABLE FOR DIRECT COMBUSTION IN BOILERS

This invention relates to improvements in the preparation of coal for combustion in boilers and furnaces and, more particularly, to converting a pipeline coal slurry into a coal water mixture for direct combustion.

Preparation of coal water mixture suitable for direct combustion in boilers is well known starting with run-of-mine coal. However, up until now, there has been no satisfactory conversion of a pipeline coal slurry into this type of coal water mixture.

Attempts have been made in the past to prepare a coal water mixture for direct combustion in a boiler or furnace in which the coal water mixture is prepared at a mine site so that the coal water mixture is in the form of a coal slurry of about 70% solids of which 80% is −200 mesh in particle size. To transport such a slurry over long distances through a pipeline, surfactants and other additives are required to render the slurry less viscous for increased flowability through the pipeline. However, it is found that the minerals in the coal in the slurry often react with the additives, often causing a jamming of the pipeline, a result which is clearly to be avoided.

Other attempts have been made for preparing a coal water mixture suitable for direct combustion in a boiler or furnace in which a coal slurry from a mine is directed along a pipeline over a long distance from the mine to a region near the boiler or furnace in which the combustion is to take place. At such region, the coal slurry is directed into a holding region, such as a pond, from whence it is directed to a dewatering apparatus with the intent to eliminate as much water from the slurry as possible. A maximum of about 90% of the water can be removed from the coal water mixture in this manner, following which the wet solids resulting from the dewatering action are ground into a suitable particle size, such as −200 mesh. Then the resulting coal product is sent directly to a boiler or furnace for combustion.

The water from the dewatering action is sent into a pond and contains a relatively large amount of coal, such as 17–20% by weight of the mixture which is the by-product of the dewatering action. This is a relatively large amount of coal and represents an inefficient use of the original slurry. This by-product can be burned as a slurry to dispose of it or such a mixture can be prepared for direct combustion in a boiler or furnace to obtain whatever energy content is available from it.

Prior techniques have been generally unsuccessful in providing a high quality coal water mixture for direct combustion from a coal slurry which has been directed through a pipeline at optimum concentrations, such as 50–55 weight percent of solids. Thus, a need exists for improvements in the transporting of coal slurries over long distances while allowing these coal slurries to be used as a coal water mixture for direct combustion in a boiler or furnace. The present invention satisfies this need.

SUMMARY OF THE INVENTION

The present invention is directed to an apparatus and method for handling a coal slurry in such a way as to achieve the aim of pipeline transfer of a coal slurry to a point of use and the economic conversion of the slurry into a coal water mixture as a combustible product. To this end, the system of the present invention includes a pipeline connecting a mine site with the point of use at which combustion is to occur. The pipeline directs the coal slurry into a holding region, such as a pond, after the slurry has moved over a relatively long distance, such as a distance in the range of 500 to 2000 miles. The slurry has an optimum content of 50–55 weight percent of solids and does not require additives to increase viscosity or enhance flowability.

From the holding region, the slurry as needed is pumped toward and into a grinding apparatus; however, a portion of the slurry directed toward the grinding apparatus forms a side stream and moves through a filtration apparatus where water is separated from the slurry to increase its solids concentration from 50–55 weight percent of solids to about 75 weight percent solids. This slurry portion of increased solids concentration is returned to the main flow of the slurry and directed toward and into the grinding apparatus. The solids concentration in the slurry entering the grinding apparatus is in the range of 65–70 weight percent.

The slurry, ground in the grinding apparatus, is reduced to an optimum particle size for combustion, such as 80% at −200 mesh. From the grinding apparatus, the ground slurry is directed into a small agitated storage tank and then moved to a boiler or furnace for direct combustion.

The primary object of the present invention is to provide an improved apparatus and method for converting a coal slurry capable of flowing through a pipeline to a coal water mixture suitable for direct combustion in a boiler wherein the coal slurry can be directed at optimum solids concentration over the pipeline and, in a region near the downstream end of the pipeline, the coal slurry can readily be converted into a coal water mixture of increased solids concentration and of optimum particle size so that such mixture can be sent directly into a boiler or furnace for direct combustion to obtain the energy values from the coal.

Other objects of this invention will become apparent as the following specification progresses, reference being had to the accompanying drawing for an illustration of the invention.

IN THE DRAWING

Figure 1:
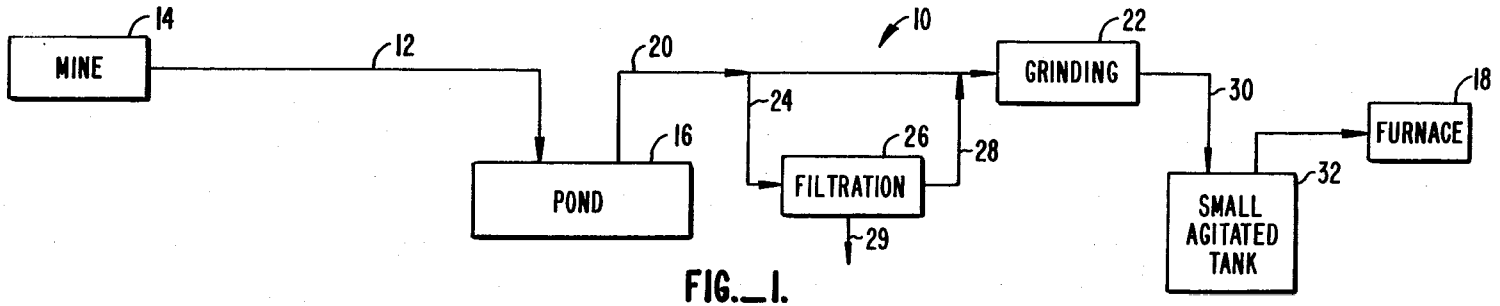
FIG. 1 is a block diagram of the system of the present invention for converting of a pipeline coal slurry to a coal water mixture suitable for direct combustion in furnaces or boilers.

The system of the present invention is broadly denoted by the numeral 10 and is shown in FIG. 1 in block form. System 10 operates to convert a pipeline coal slurry to a coal water mixture suitable for direct combustion in a furnace. System 10 includes a slurry pipeline 12 whose upstream end is coupled to a mine 14 from which a mixture of coal and water is provided to form the slurry to be directed into and through pipeline 12. The pipeline length can be of any value; however, such length could be in the range of 500 to 2000 miles. Moreover, at the mine 14, suitable equipment (not shown) will be provided to form the coal-water slurry to be directed into the upstream end of pipeline 12. The slurry is in the weight percent range of 50–55 weight percent of solids. A slurry with solids in this range has been commercially proven to be an optimum mixture for low-cost transportation over long distances.

System 10 further includes a pond 16 which is conventional, pond 16 being in the vicinity of the end use location of the coal-water slurry, such as in the region near a furnace 18 which is to receive the coal water mixture for combustion purposes. A pipeline 20 of relatively short length couples pond 16 to the inlet of a grinding apparatus 22 which typically is a wet ball mill.

To provide a coal water mixture for combustion in furnace 18, the solids content of the slurry must be increased beyond 50–55% solids because such slurry has too much water for direct combustion. To achieve this end, a side stream of slurry from pipeline 20 is directed through a line 24 into a filtration apparatus 26 for solids-water separation. A line 28 couples the downstream end of apparatus 26 back to pipeline 20. Apparatus 26 can be of any suitable type, such as a screen bowl centrifuge, a solid bowl centrifuge, a vacuum filter, or a belt filter press.

The purpose of filtration apparatus 26 is to separate some of the water from the coal-water portion from pipeline 20 so that, when the wet solids from apparatus 26 are recombined with the slurry in pipeline 20, the resultant weight percent of coal in the pipeline mixture entering grinding apparatus 20 will be increased and will vary from 60–70 weight percent of solids. This is to be contrasted with a slurry having a 50–55 weight percent of solids leaving the pond 16 through pipeline 20. The water removed from the slurry by filtration apparatus 26 is directed along a line 29 for disposal or for other uses.

The slurry in grinding apparatus 22 is ground to produce a particular fines content, generally 80% of which is −200 mesh and of from 65–70 weight percent of solids. The slurry from grinding apparatus 20 is directed along a line 30 into a small agitated tank 32 from whence it can be pumped into furnace 18 as needed for combustion.

In operation, coal is mined at mine 14 and, near the mine, the coal is combined with water to form a coal-water slurry. Such a slurry is directed into the upstream end of pipeline 12 and pumped along the length of the pipeline and caused to enter pond 16. The pond 16 is in close proximity to furnace 18, the end use location of the coal water slurry. As the need arises, a slurry is directed out of pond 16 along pipeline 20 toward and into grinding apparatus 22. A sidestream of the slurry from pipeline 20 is directed along line 24 into filtration apparatus 26 where some water is separated from the slurry to enrich the solids content of the slurry to about 75% solids so that, when the slurry from filtration apparatus 26 is sent along line 28 back into pipeline 20, the slurry entering grinding apparatus 22 will have a solids content in the percent weight range of 65–70% solids.

The slurry is ground in apparatus 22 and then directed along line 30 out of the apparatus 22 into small agitated tank 32 from whence it is pumped to furnace 18 as needed for combustion. When ready for combustion, the slurry can be charged to furnace 18 for direct combustion. For coal water mixtures containing from 68–75% coal, a chemical suspending agent typically in the chemical class of carbohydrates, wetting agents or cellulosic compounds may be added to insure that the coal remains uniformly suspended in the water.

The process of operation of system 10 is superior in investment and operating cost requirements to the alternative of preparing a coal water mixture starting with run-of-mine coal and pumping the same through a long pipeline to a point of use. System 10 allows for a lower pressure drop along pipeline 12 and a lower energy cost as well as the use of smaller pipe diameter for transporting fine coal slurries containing 15–30 weight percent fines (particles finer than 200 mesh). System 10 is to be contrasted to conventional systems of the types shown in FIGS. 2 and 3 which are operable to transport coal water mixtures containing up to 80% fines in a coal water slurry and up to 78 weight percent coal through long pipelines.

Figure 2:
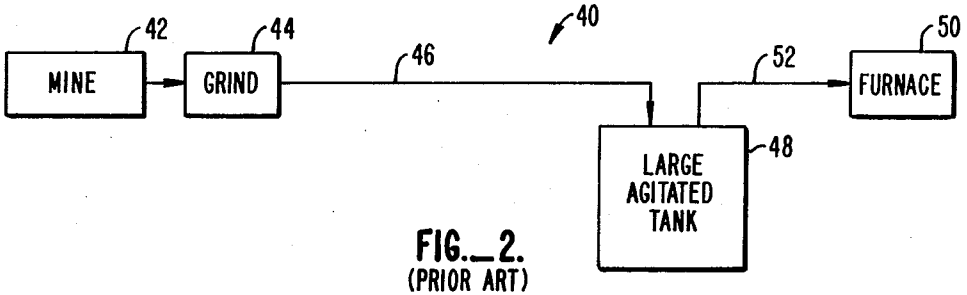
FIG. 2. (PRIOR ART)
FIG. 2 is a block diagram of a first prior art system for combustion of a coal water mixture in a furnace.

The prior art system denoted by the numeral 40 in FIG. 2 relates to the formation of a coal water mixture from a mine 42 having a grinding apparatus 44 adjacent thereto for grinding the coal into fines with at least 80% of the fines at −200 mesh. Such fines are used to form a coal slurry having a solids content of about 70 weight percent. This slurry is directed over long distances through a slurry pipeline 46 to a large agitated storage tank 48 in the vicinity of an end use, such as a furnace 50.

Long-term storage requires the tank 48 be of large volume and the tank must be agitated so that the solids in the slurry in tank 48 remain in suspension at all times and ready for use as a coal product to be pumped along a line 52 to furnace 50. Agitation of the slurry in tank 48 requires high power dissipation. Moreover, in transporting the slurry from grinding apparatus 44 as a slurry through pipeline 46, surfactants are required to make the slurry less viscous and to increase the flowability of the slurry. However, the minerals in coal react with the surfactants and other additives and sometimes cause jamming of the pipeline, requiring the pipeline to be shut down until the jammed portion is opened. In the present invention as set forth in FIG. 1, no such additives or surfactants are required. Moreover, the control of the way in which the coal water mixture is formed is achieved at the mill end of the pipeline 46 and this feature of system 40 makes it unreliable inasmuch as the slurry can change considerably between mine 42 and the region of furnace 50.

Figure 3:
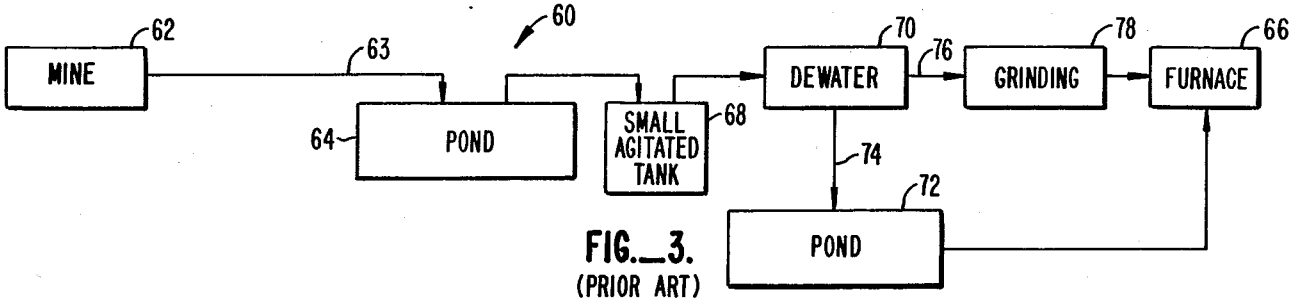
FIG. 3. (PRIOR ART)
FIG. 3 is a block diagram of a second prior art system for combustion of a coal water mixture in a furnace.

Another prior art system is shown in FIG. 3 and is denoted by the numeral 60. This system is the type used with the Black Mesa coal slurry pipeline in Arizona. In this system, coal from a mine 62 is used to form a slurry which is directed along a pipeline 62 to a Marcona pond 64 near a region in which a furnace 66 is located. Slurry from Marcona pond 64 is directed outwardly to a small agitated tank 68 and from this tank to a dewatering apparatus 70 where as much as 90% of the water is removed, leaving the slurry with a 90% weight percent of solids in the slurry. The water is directed to a pond 72 along a line 74 for storage. The slurry output from dewatering apparatus 70 is directed along a line 76 to a grinding and drying apparatus 78, such as a pulverizer. From the grinding apparatus, the coal is sent directly to furnace 66 for combustion.

The drawback associated with system 60 is that too much coal is directed out of dewatering apparatus 70 into pond 72. While a slurry can be formed from pond 72, the slurry will only have a small content of solids, such as at 17–18 weight percent at most, and these solids can be directed in a slurry to furnace 66 and burned without much energy recovery therefrom. Thus, when contrasted with the operation of system 60, the operation of system 10 is much more efficient and achieves a greater, more efficient combustion of slurry without the need for the high concentration of solid in the slurry directed into the furnace as is required with the operation of system 60.

We claim:

1. A system for preparing coal for direct combustion in a boiler comprising:

a pipeline adapted to extend from a coal source to the region at which the boiler is located, the pipeline adapted to carry a coal slurry to said region;

means at said region for holding the coal slurry received from said pipeline;

means adjacent to said holding means for grinding a coal slurry;

a fluid line for coupling the holding means with the grinding means, said fluid line having means between the ends thereof for dividing the fluid line into a pair of fluid paths;

means coupled with one of said fluid paths for dewatering the part of said slurry portion therein so as to increase the solids content of said slurry portion before the latter reaches said grinding means; said other fluid path directly coupled to said grinding means to allow the remaining part of the slurry to flow directly into the grinding means and means coupled with the grinding means for directing the coal slurry portion from the grinding means toward a boiler.

2. A system as set forth in claim 1, wherein the pipeline is of a size permitting a coal slurry of 50–55 weight percent of solids to flow to said holding means from the mine region.

3. A system as set forth in claim 1, wherein said holding means includes a pond.

4. A system as set forth in claim 1, wherein said grinding means includes a wet ball mill.

5. A system as set forth in claim 1, wherein said receiving and dewatering means includes a screen bowl centrifuge.

6. A system as set forth in claim 1, wherein said receiving and dewatering means includes a solid bowl centrifuge.

7. A system as set forth in claim 1, wherein said receiving and dewatering means includes a vacuum filter.

8. A system as set forth in claim 1, wherein said receiving and dewatering means includes a belt filter press.

9. A system as set forth in claim 1, wherein said receiving and dewatering means is operable to change the solids concentration in said slurry portion to a concentration in the range of 70 to 80 weight percent of solids.

10. A system for preparing coal for direct combustion in a boiler comprising:

a pipeline adapted to extend from a coal source to the region at which the boiler is located, the pipeline adapted to carry a coal slurry to said region;

means at said region for holding the coal slurry received from said pipeline;

means adjacent to said holding means for grinding a coal slurry;

a first fluid line for coupling the holding means with the grinding means to allow at least a portion of the slurry from the holding means to flow toward and into the grinding means;

a filtration apparatus having an inlet and an outlet, there being a second fluid line coupled to the first fluid line and to the inlet of the filtration apparatus, and a third fluid line coupling the outlet of the filtration apparatus and the first fluid line upstream of the grinding means, whereby a part of said slurry portion can be dewatered before the latter reaches said grinding means to increase the solids content of said slurry portion; and means coupled with the grinding means for directing the coal slurry portion from the grinding means toward a boiler.

11. A method for preparing coal for direct combustion in a boiler comprising:

moving a coal slurry from a coal source to a region at which a boiler is located;

holding the coal slurry in a confined space at said region;

directing a flow of at least a part of the coal slurry from said space toward a grinding zone;

dividing said flow into two fractions before the slurry part reaches said grinding zone;

dewatering one of said fractions of said slurry part;

uniting the dewatered fraction with the other fraction at a location upstream of said grinding zone to increase the solids content of said slurry part;

grinding said slurry part at said grinding zone; and advancing said slurry part from the grinding zone toward said boiler.

12. A method as set forth in claim 11, wherein the coal moving from said coal source is of a 50–55 weight percent of solids.

13. A method as set forth in claim 11, wherein the slurry part entering the grinding zone is of a 70–80 weight percent of solids.

14. A method as set forth in claim 11, wherein said holding step includes directing the slurry into a pond.

15. A method as set forth in claim 11, wherein said grinding step includes subjecting said slurry part to a wet ball mill.

16. A method as set forth in claim 11, wherein said dewatering step includes centrifuging the slurry part.

17. A method as set forth in claim 11, wherein said dewatering step includes filtering said slurry part.

18. A method as set forth in claim 11, wherein said dewatering step includes forming a side stream with said slurry fraction, separating a portion of the water from said slurry fraction in the side stream to increase the concentration thereof, and returning the concentrated fraction to the flow of said slurry part toward said grinding zone.

19. A method as set forth in claim 11, wherein said advancing step includes shifting the slurry part into a second holding space, and directing at least a portion of the slurry part in the second space to a boiler for combustion.

* * * * *